United States Patent [19]

Nickerson

[11] Patent Number: 4,887,405

[45] Date of Patent: Dec. 19, 1989

[54] COMPRESSIBLE FOAM INSERT FOR BUILDING BLOCKS

[76] Inventor: Jeffrey A. Nickerson, Nelson Street - P.O. Box 592, Warren, Mass. 01083

[21] Appl. No.: 302,620

[22] Filed: Jan. 27, 1989

[51] Int. Cl.[4] ..... E04B 1/80

[52] U.S. Cl. ..... 52/309.12; 52/405

[58] Field of Search ..... 52/404, 405, 406, 407, 52/809, 309.12; 428/163, 167

[56] References Cited

U.S. PATENT DOCUMENTS 3,885,363 5/1975 Whittey ..... 52/405

4,426,818 1/1984 Hoffmann ..... 52/406

4,631,885 12/1986 Iannelli ..... 52/98

*Primary Examiner*—John E. Murtagh

*Attorney, Agent, or Firm*—Chapin, Neal & Dempsey

[57] ABSTRACT

A preferred insulative foam insert to be placed in the cores of masonry building blocks. The inserts are rectangularly formed with top and bottom surfaces and front and back faces. Compression slots are formed in the insert and extend upwardly a substantial distance from the bottom surface; they also extend laterally from the front and back faces a depth which is at least equal to half the width of the insert. The compression slots provide an end-to-end compression of the insert for fitting blocks having different core sizes.

3 Claims, 1 Drawing Sheet

COMPRESSIBLE FOAM INSERT FOR BUILDING BLOCKS

BACKGROUND OF THE INVENTION

This invention relates to insulated inserts for the cores of masonry building blocks which may fit into cores of substantially different sizes and shapes.

U.S. Pat. No. 4,631,885 to Iannarelli discloses a compressible insulated insert for the cores of masonry building blocks. The slots 46 account for the majority of the compressibility of the inserts, but since the slots are relatively short and few in number, the inserts have limited compressibility.

U.S. Pat. No. 4,462,195 to Nickerson discloses an insert which has hinged sections (34) which may be bent so that the insert may conform to different shaped cores. The configuration of the insert, itself, is not compressible as is the insert embodying my invention.

U.S. Pat. No. 3,885,363 to Whittey shows an insulated insert with slots (26, 40, etc.) which permit the insert to be compressed. However, none of the inserts disclose a combination of slots extending the full width of the cross-section of the insert whereby compression would be limited to the compressibility of the insert material per se.

The principal object of this invention is to produce a preformed insulative foam insert for a masonry building block such that the insert may be inserted into and conform with building blocks of different core sizes and shapes.

Another object of this invention is to provide a compressible insulated insert in which none of the material of the insert is severely deformed during compression.

The above and other objects and advantages of this invention will be more readily apparent from the following description read in conjunction with the accompanying drawings, in which.

Figure 1:
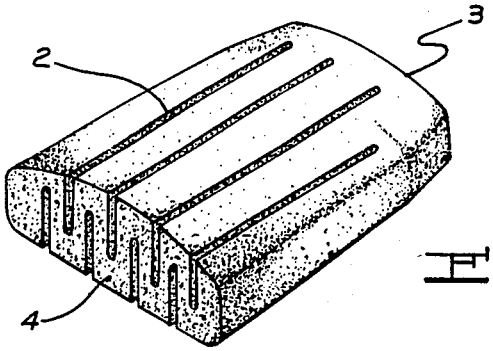
FIG. 1 is a perspective view illustrating the preformed insulative foam insert for a core of a masonry building block of this invention.

FIGS. 1–4 show one embodiment of the insulated insert 1 for masonry building blocks. The insert is preformed from foam or other similar materials. The insert comprises a top surface 3, bottom surface 4, front face 14 and back face 19. Compression slots 2 are interspaced, preferably in equal numbers, extending from the front and the back faces of the insert These compression slots extend at least one-half the width of the insert. Said insert may be curved on one face, as shown by 14 in FIG. 3, and flat on the other face 19 so that the same insert can conform to building blocks with cores of different sizes and shapes.

A preferred dimension for the insert is approximately 7½ inches high, a maximum of 2½ inches thick and 6½ inches wide at its lower surface and 5 inches at its upper surface.

Figure 3:
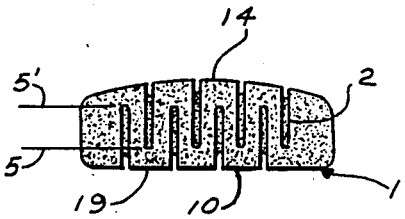
FIG. 3 is the bottom plan view of the insulated insert of FIG. 1.
Figure 4:
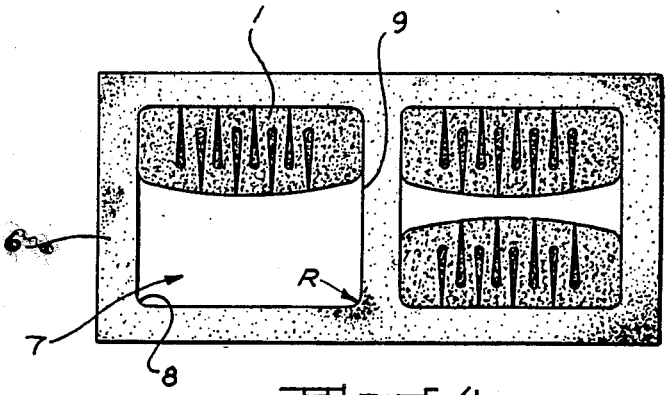
FIG. 4 is a bottom plan view of the insulated inserts of this invention while encased in position within a masonry block with a rectangular shaped core with the inserts in a compressed state.

FIGS. 3 and 4 show the effect of lateral compression upon the compression slots 2. This insert will function properly if the compression slots from both faces extend longitudinally at least half the width of the insert which will enable compression over the entire width of the insert. However, overlap of the slots, as shown between 5 and 5' of FIG. 3, is preferred since it will require less force to compress the insert. Considering that when there is substantial overlap, the center portion of the inserts (between 5 and 5') will be capable of greater compressibility than conventional inserts.

Figure 2:
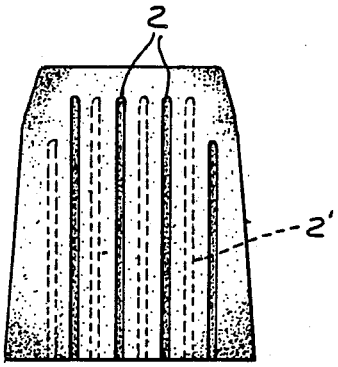
FIG. 2 is a front elevational view of the insulated insert of FIG. 1.

Since the upper surface has a lesser width than the lower surface, the lower portion of the insert will be subject to greater compression when the insert is placed in a core of uniform cross-section. Therefore, as seen in FIGS. 1 and 2, the compression slots 2 extend from the lower surface 4 which is larger in cross-section than the upper surface.

Since the slots do not extend over the full height of the inserts, the inserts will have increased overall structional strength and will resist longitudinal bending forces.

The inserts 1 can be fitted into concrete blocks having different shaped cores. For example, FIG. 4 shows the bottom view of a concrete block 6 with rectangular cores 7, the recess has rounded corners 8, having a small radius R and flat surfaces 9. When the insert is placed into a block with cores of this shape, the flat side of insert 1 is placed against the flat wall of the core.

However, when inserts are placed in pear-shaped cores (in which the rounded corners have a relatively large radius R), the insert may be reversed such that the rounded edges 14 of the insert are in contact with the radius R edge of the core. In this manner, one insert may fit cores of considerably different sizes and shapes.

The sides of the cores of masonry blocks are normally tapered from top to bottom such that when the blocks are in their normal building position, the cross-section of the top of the core opening is smaller than the lower portion of the core opening. FIG. 2 shows that the insert is tapered such that the top surface 3 is smaller in cross-section than the bottom surface 4 to conform to the taper of the cores. The top portion of the insert is solid for restricting the upward flow of air through the inserts and thereby preventing the escape of rising hot air.

To place the tapered insert within the masonry blocks, the block is inverted, and the insert is fitted into the block with its solid, smaller end disposed downward into the cores of the block. The masonry block may then be reversed for use in its building function. The bottom view of this arrangement is best illustrated in FIG. 4.

Figure 5:
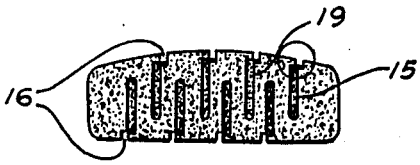
FIG. 5 is a bottom plan view of the insulated insert of another embodiment of my invention.
Figure 6:
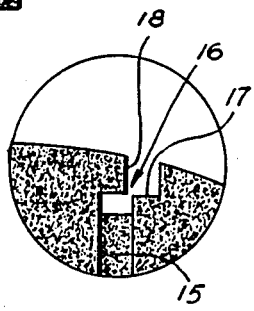
FIG. 6 is an enlarged view of a portion of the insert shown in FIG. 5.

FIGS. 5 and 6 illustrate a modified embodiment of my invention. Compression slots 15 have interfitting edge portions, as indicated generally at 16, comprising a notch or cutout 17 and a laterally extending projection 18. The projections 18 fit into the notches 17 to seal the inner channel 19 of the slot, thus further reducing the "chimney effect" and increasing the insulation of the inserts, especially near the upper portion of the insert where there is less compressive force to close the outside surfaces of the slots.

The specific shape of the outer surface of the insert should not be considered as limiting, since the overlaying compression slots could be applied to inserts which are rectangular, oval, slab-like, or have many other configurations.

Having thus described my invention, what is claimed is:

1. Insulating foam insert for building blocks shaped to conform to the cores of different sizes and shapes of building blocks, said insert comprising an integral foam body of generally rectangular overall shape having upper and lower surfaces, sidewalls and a front and back face, said insert being inwardly tapered in cross-section from its lower to its upper surface and compression slots which extend upwardly from the lower surface of the insert and terminate a substantial distance below the upper surface thereof which is thereby solid in cross-section and prevents the upward escape of heated air from said slots, alternate of said compression slots extending in opposite directions from one face toward the opposite face thereof a distance greater than one-half the cross-sectional width of said insert such that the compression slots are coextensive within the body of the insert whereby compressibility is enhanced laterally of the coextensive portions of said slots.

2. Insulating foam insert for building blocks, as set forth in claim 1, wherein at least one face of the insert has a generally planar configuration and at least one face of the insert is convexly curved.

3. Insulating foam insert for building blocks, as set forth in claim 2, wherein an outer edge portion of the compression slots include interfitting edge portions which, upon compression, close and seal the open edges of said slots, whereby said slots provide the dead air voids within the body of said insert.

* * * * *